US007980379B2

(12) United States Patent
Winkler

(10) Patent No.: US 7,980,379 B2
(45) Date of Patent: Jul. 19, 2011

(54) CONVEYANCE DEVICE

(75) Inventor: Gerald Winkler, Neusiedl am See (AT)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 12/576,495

(22) Filed: Oct. 9, 2009

(65) Prior Publication Data

US 2010/0025186 A1 Feb. 4, 2010

Related U.S. Application Data

(63) Continuation of application No. PCT/EP2008/054380, filed on Apr. 10, 2008.

(30) Foreign Application Priority Data

Apr. 10, 2007 (EP) ..... 07105885

(51) Int. Cl.
*B65B 21/00* (2006.01)

(52) U.S. Cl. ..... 198/327; 198/330; 198/331; 198/335

(58) Field of Classification Search ..... 198/326–327, 198/329–331, 333, 335
See application file for complete search history.

(56) References Cited

U.S. PATENT DOCUMENTS

| | | | | |
|---|---|---|---|---|
| 2,823,785 | A * | 2/1958 | Hefti | 198/328 |
| 4,179,020 | A * | 12/1979 | Heusler et al. | 198/326 |
| 4,206,708 | A * | 6/1980 | Behle | 104/172.3 |
| 4,811,829 | A * | 3/1989 | Nakazawa et al. | 198/326 |
| 6,138,815 | A * | 10/2000 | Reiners et al. | 198/321 |
| 6,527,098 | B2 * | 3/2003 | Krampl | 198/326 |
| 2002/0084169 | A1 * | 7/2002 | Schulte et al. | 198/337 |
| 2009/0173596 | A1 * | 7/2009 | Fang et al. | 198/330 |

FOREIGN PATENT DOCUMENTS

| | | |
|---|---|---|
| CN | 1817775 | 8/2006 |
| GB | 2 316 927 | 3/1998 |
| WO | 2007/107086 | 9/2007 |

* cited by examiner

*Primary Examiner* — Mark A Deuble
(74) *Attorney, Agent, or Firm* — Ladas & Parry LLP

(57) ABSTRACT

A conveyance device has two endless arrangements of tread steps, step plates or pallets driven in a transportation direction by a drive. Adjacent to a first longitudinal side of the first arrangement is a first balustrade with a handrail, and adjacent a second longitudinal side of the first arrangement is a second balustrade and handrail. The second arrangement is located parallel and next to the first arrangement and is also driven by the drive. The second balustrade is configured as a center balustrade between the two arrangements to be used by persons on both arrangements. A third balustrade and handrail is adjacent a second side of the second arrangement.

10 Claims, 3 Drawing Sheets

CONVEYANCE DEVICE

The invention relates to a conveyance device, such as an escalator or moving walk. The present application is a continuation of PCT/EP2008/054380 filed Apr. 10, 2008.

BACKGROUND OF THE INVENTION

Conveyance devices of this type are escalators and moving walks that have an endless arrangement of tread steps or tread plates, respectively. Adjacent to the long sides of the endless arrangement of tread steps or tread plates that extend in the direction of transportation are side, or upright, balustrades with handrails onto which persons who are present on the tread plates or tread steps can hold. The endless arrangement with the tread plates or tread steps and the handrails are, or can be, driven simultaneously, the handrails either slightly faster or synchronously.

There is frequently the need or desire to increase the transportation capacity of such conveyance devices.

The simplest solution that presents itself for this purpose is to increase the width of the tread steps or tread plates perpendicular to the transportation direction and thereby increase the mutual distance between the two side balustrades. This solution can, however, not usually be realized, because safety regulations restrict the mutual distance between the side balustrades to a maximum permissible value, with the purpose of ensuring that persons on the tread steps or tread plates can hold on to, or support themselves on, both side handrails or balustrades simultaneously.

Another arrangement to increase the transportation capacity of such a conveyance device is known from JP9-110350-A. There, in addition to a first endless arrangement of tread steps or tread plates, a second endless arrangement of tread steps or tread plates is provided which, with the exception of a boarding area and an exiting area, extends parallel and immediately adjacent to the first endless arrangement. The second endless arrangement of tread steps or tread plates has a faster-working motor or drive than the first endless arrangement. A first balustrade with handrail is located on the long side of the first endless arrangement, which faces away from the second endless arrangement. A second balustrade with handrail is located on the long side of the second endless arrangement, which faces away from the first endless arrangement. Between the two endless arrangements of steps or plates or pallets there is no balustrade and no other necessary handrail. It is foreseen that, in the boarding area, people in a hurry step onto the tread elements of the first endless arrangement, then change or jump onto the tread steps or tread plates of the second endless arrangement, and finally, in the exit area, change back to the tread steps or tread plates of the first endless arrangement. This greatly increases the danger of accidents, and cannot be expected of older persons. Also, persons who are not in a hurry remain on the tread plates or tread steps of the first endless arrangement, and are overtaken by those on the second endless arrangement.

This arrangement has several disadvantages. One is that it may be difficult to keep both endless arrangements so narrow that the maximum width prescribed by regulations is not exceeded. It may in any event be difficult for persons to support themselves with both hands at the sides, since the handrail of the second endless arrangement is presumably driven faster than the handrail of the first endless arrangement or escalator. Furthermore, here too, the total transportation capacity is limited by the access area and the exit area, both of which have only the width of the first endless arrangement. Finally, the accident hazard may be relatively high.

The task of the invention is therefore to propose an improved conveyance device of the type stated at the outset with which, in a simple manner and by simple means, while complying with the safety regulations, the transportation capacity can nonetheless be increased and material savings and cost savings achieved.

BRIEF DESCRIPTION OF THE INVENTION

A new conveyance device in accordance with the invention adapted to meet the foregoing task usually serves to transport persons, and has an endless arrangement of tread plates, tread steps or pallets. This endless arrangement can be driven in at least one, or in both, transportation direction(s) by driving means. Provided adjacent to a first long side of the first endless arrangement of steps or plates or pallets is a first side balustrade, which has on top a slightly faster-running first handrail which can be driven in the direction of transportation. Provided adjacent to the second long side of the first endless arrangement is a second side balustrade, also with a slightly faster-running second handrail which can be driven in the direction of transportation. The arrangement that is described up to this point is known.

According to the invention, the conveyance device has, in particular, an additional endless arrangement with tread plates or tread steps. This additional endless arrangement is arranged parallel to the first endless arrangement, and preferably can be driven by the present driving means in the direction of transportation, and simultaneous with the first endless arrangement. The aforesaid second side balustrade is embodied as a middle balustrade or central balustrade. It is arranged between the second long side of the first endless arrangement and a first long side of the second endless arrangement. This middle balustrade can therefore be used by persons on the first endless arrangement as well as by persons on the second endless arrangement. A third side balustrade is normally arranged on a second long side of the second endless arrangement of tread steps or tread plates which is located opposite to its first long side. This third balustrade has a third handrail which can normally be driven in the direction of transportation simultaneous with the second handrail.

According to the invention, the two endless arrangements can be driven not only simultaneously and together but also synchronously, and the first endless arrangement, the additional endless arrangement, and the three handrails can have approximately, or virtually, the same speed. The two endless arrangements can have the same direction of travel, and the three handrails belonging to them can also have the same direction of travel. The three handrails can slide or run mutually synchronously and can have the same or identical handrail speed.

The new conveyance device can also be embodied in such manner that the middle balustrade is subdivided into a first partial balustrade and a second partial balustrade. The first partial balustrade of the middle balustrade is then arranged on the side of the first endless arrangement, while the second partial balustrade of the middle balustrade or central balustrade is arranged on the side of the second endless arrangement. The first partial balustrade has a first partial handrail and the second partial balustrade has a second partial handrail. This variant of the new conveyance device can alternatively be used in various modes, for certain modes the driving means requiring a suitable gear with corresponding gearing down or gearing up.

In a first mode, the complete transportation arrangement, specifically the two endless arrangements of tread steps or tread plates or pallets, the first and third handrail, and the two partial handrails of the middle balustrade or central balustrade, are driven in the same direction of transportation and with the same speed.

In another mode, a first transportation unit comprising the first endless arrangement of tread steps or tread plates or pallets, the first handrail, and the first partial handrail of the middle balustrade or central balustrade, is driven at a first speed. A second transportation unit, comprising the second endless arrangement, the third handrail, and the second partial handrail of the middle balustrade or central balustrade, is driven at another, second, speed. Driving is effected as in the first mode by common driving means. Furthermore, the drive can also be driven via a common main gear and one or more drive units or motor units that are flanged-on or added-on. Moreover, a separate motor unit, gear unit, or motor/gear combination can be used. Persons in a hurry can use the fast transportation unit, while for others, for example persons who have difficulty in walking, or whose walking is impaired, the slow transportation unit is available. By driving both units in the same direction but with different speeds, a fast and a slow transportation unit are obtained. The effect is thus achieved that is striven for in JP9-110350-A, but without its manifest and obvious disadvantages.

To limit equipment outlay, both transportation units are driven by a common drive. In the variant where one of the conveyance devices is moved faster than the other, a suitable gear is used to gear-down a fast-running drive, or to achieve an additional slow-running pre-gearing-down.

In case of a low requirement for transportation capacity, one of the transportation arrangements can be uncoupled from the drive means and thereby shut down. Furthermore, one drive can be electrically isolated or switched off, or switched to crawling speed. For this purpose a coupling (e.g. a clutch), a separating device, or a connecting device for uncoupling or separating, and for engaging and coupling, can be provided.

Furthermore, the two transportation units can be deployed either in the same transportation direction, or in opposite transportation directions, as needs be. In this case, the common drive is provided with a gear that generates on the drive side an opposite direction of rotation for one of the two conveyance devices.

BRIEF DESCRIPTION OF THE DRAWINGS

The present invention is described in detail below in relation to examples and by reference to the following drawings, wherein.

DETAILED DESCRIPTION OF THE INVENTION

Figure 1:
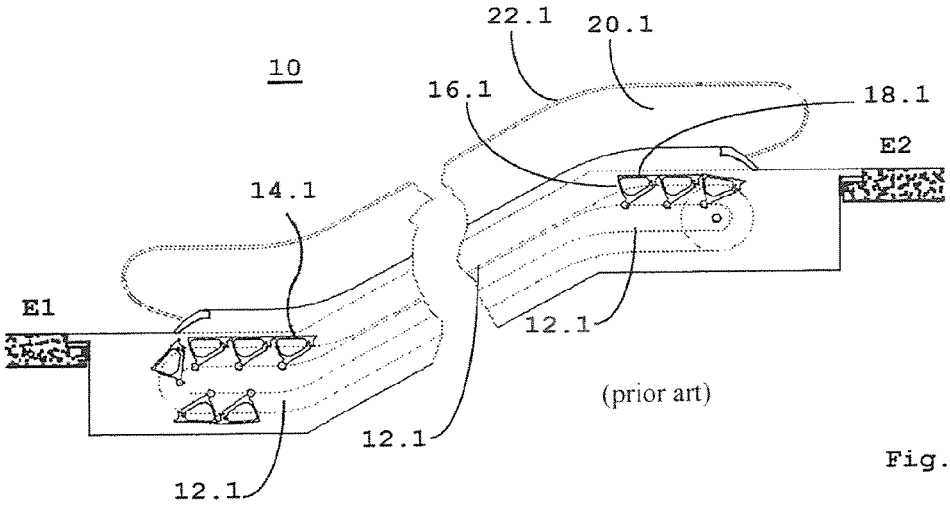
(prior art) Fig. 1
FIG. 1 is a diagrammatic view of a conventional conveyance device in the form of an escalator of the type embodying the invention, viewed from the side, partly cut away.

The known conveyance device that is shown in FIG. 1 is an escalator 10. This escalator 10 transports persons or, if needs be, hand baggage and small goods, in a transportation direction from a lower level E1 upwards to an upper level E2. Usually, such escalators 10 have drives that can be controlled, or switched over, so that the escalator 10 can alternatively also transport persons from the upper level E2 downwards to the lower level E1.

The escalator 10 has a first endless arrangement 12.1 with a plurality of tread elements or tread steps 14.1, each tread element 14.1 having a step-riser 16.1 and a tread plate 18.1. The endless arrangement 12.1 can be driven by a drive or by driving means as known (not shown).

Located on a first long side of the endless arrangement of steps, plates or pallets 12.1 (sometimes referred to herein collectively as "steps") as is a first balustrade 20.1, and on a second long side of the endless arrangement 12.1 that is located opposite the first long side is a second balustrade 20.2. (See FIG. 2.) The balustrades 20.1 and 20.2 are provided at the top with a first handrail 22.1 and a second handrail 22.2 (not visible in FIG. 1) respectively. The handrails 22.1 and 22.2 can be driven simultaneously and in the same direction (referred to as the direction of travel, or direction of transportation) as the endless arrangement of steps or pallets 12.1.

Conveyance devices in the form of moving walks also have endless arrangements with tread elements or steps or pallets, and have balustrades arranged on their long sides. The tread elements of the moving walks have tread plates or tread pallets but no step riser parts.

Figure 2:
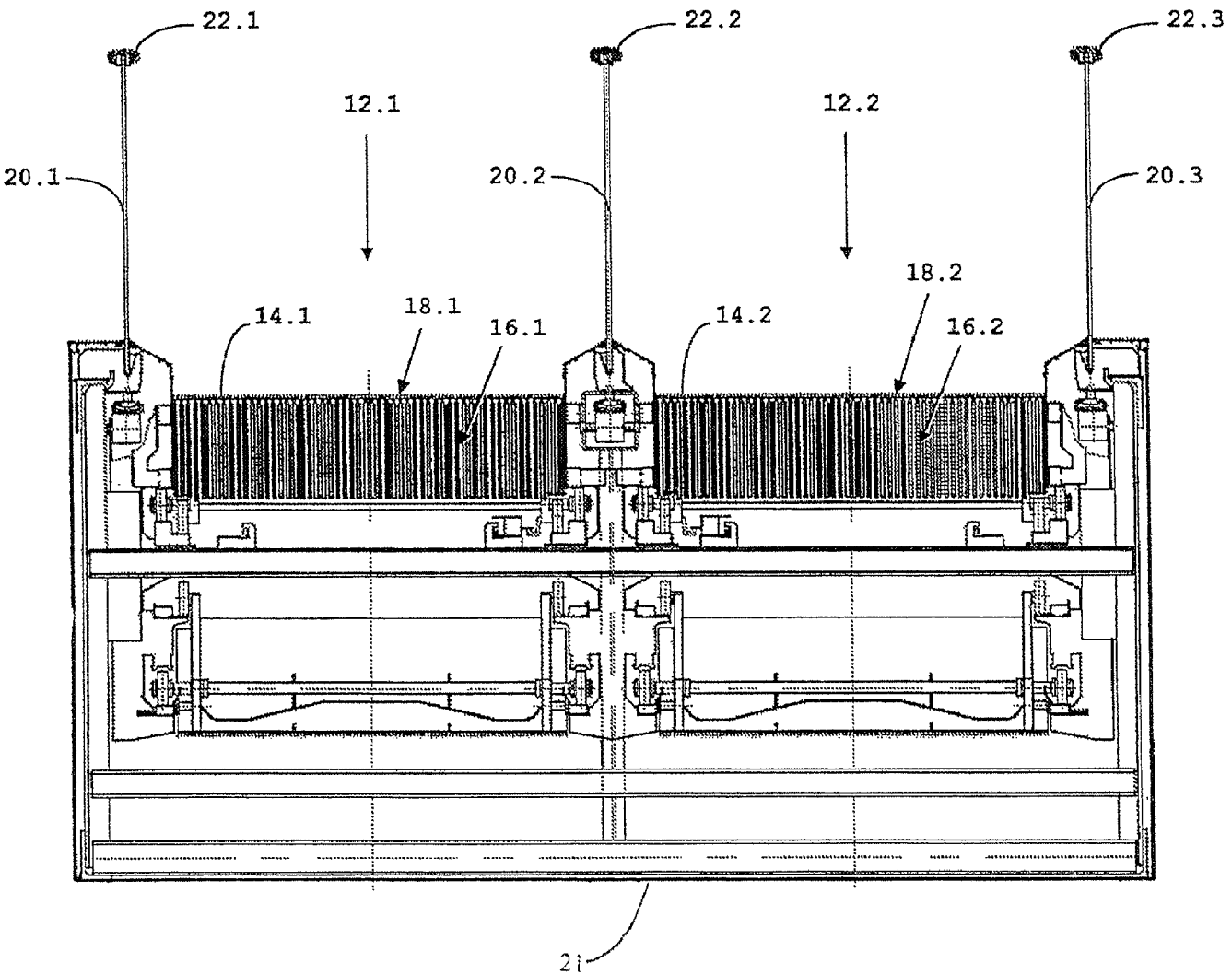
FIG. 2 is a cross-sectional view of a first exemplary embodiment of a conveyance device according to the invention, viewed in the direction of transportation.

FIG. 2 shows an exemplary embodiment of the conveyance device 10 according to the invention. This conveyance device has a first endless arrangement of steps or pallets 12.1 and a second endless arrangement of steps or pallets 12.2. Shown in FIG. 2 are a tread element 14.1 of the first endless arrangement 12.1, and a tread element 14.2 of the second endless arrangement 12.2. Of the tread elements 14.1 and 14.2, step risers 16.1 and 16.2 are visible as surfaces with grooves and projections, while tread plates and tread steps 18.1 and 18.2 are aligned horizontally (perpendicular to the plane of the drawing) and therefore only visible as lines.

At the side, in FIG. 2 left of the first endless arrangement of steps or pallets 12.1, there is a first balustrade 20.1, which on the top is provided with a first handrail 22.1. The first balustrade 20.1 is locationally fixed, and the first handrail 22.1 can be driven like the first endless arrangement of steps or pallets 12.1. At the side, in FIG. 2 to the right of the first endless arrangement 12.1, is the second balustrade 20.2, which is here embodied as the middle or central balustrade and separates the first endless arrangement 12.1 from the second endless arrangement 12.2. The second, middle balustrade 20.2 is provided at the top with the second handrail 22.2. The second balustrade 20.2 is locationally fixed, and the second handrail 22.2 can be driven like the endless arrangements 12.1 or 12.2.

At the side, in FIG. 2 at the right of the second endless arrangement of steps or pallets 12.2, there is a third balustrade 20.3, which on the top is provided with a third handrail 22.3. The third balustrade 20.3 is locationally fixed, and the third handrail 22.3 can be driven like the second endless arrangement of steps or pallets 12.2. Both endless arrangements and the balustrades are mounted on a common truss 21. As shown, the truss may be of a double truss frame construction with at least one basis frame and auxiliary frame, and may utilize full-plate construction.

Figure 3:
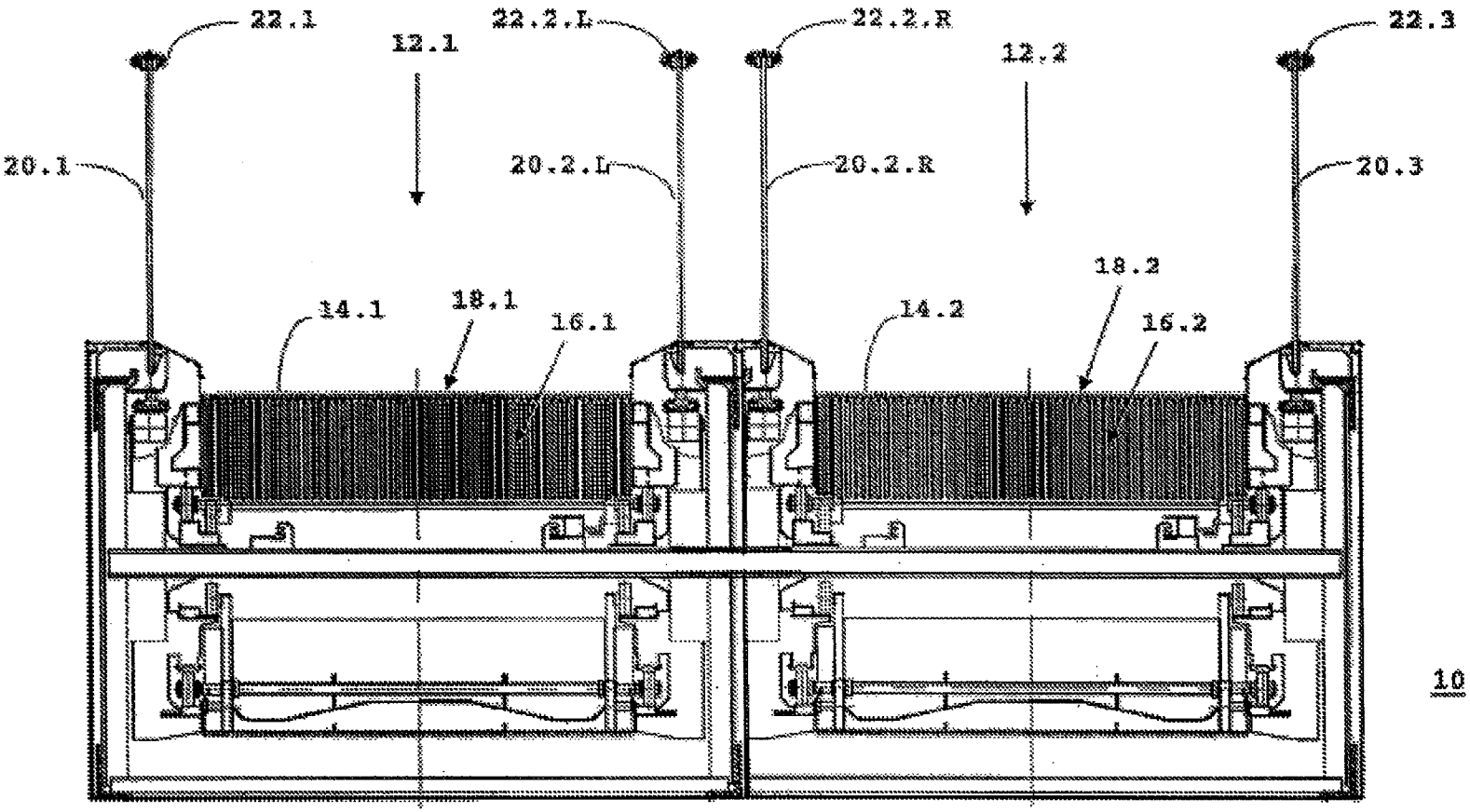
FIG. 3 is a cross-section view of a second exemplary embodiment of a conveyance device according to the invention, in the same representation as in FIG. 2.

FIG. 3 shows a further exemplary embodiment of the conveyance device 10 according to the invention. This exemplary embodiment differs from the exemplary embodiment shown in FIG. 2 in that the second balustrade 20.2, which separates the first endless arrangement of steps or pallets 12.1 from the second endless arrangement of steps or pallets 12.2, and which is also is designated as the middle or central balustrade, comprises a first partial balustrade 20.2.L and a second partial balustrade 20.2.R. The handrail of the middle or center balustrade is, like the middle or central balustrade itself, subdivided into a first handrail element 22.2.L on the first partial balustrade 20.2.L and a second handrail element 22.2.R on the second partial balustrade 20.2.R. This first endless arrangement 12.1, together with the first handrail 22.1 and the first handrail element 22.2.L of the second balustrade 20.2.L, forms a first transportation unit, and the second endless arrangement 12.2 together with the third handrail 22.3 and the second handrail element 22.2.R of the second balustrade 20.2.R forms a second transportation unit, the common driving means serving to drive the two endless arrangements 12.1 and 12.2 as well as the handrails 22.1, 22.2.L, 22.2.R, 22.3. In addition to the common motorized drive or controllable drive, the driving means can contain a suitable (e.g. switchable) gear, so that if necessary the first transportation unit 12.1 and the second transportation unit 12.2 can be selectably driven at the same or different speed(s).

The conveyance devices according to the invention have the advantage that they significantly increase transportation capacity. The technical, material, and mechanical outlay, as well as the work outlay, are, however, significantly less than for two conventional conveyance devices. Moreover, a common drive or drive block or gear block or main gear or main gear casing can be used. Furthermore, main gears or add-on gears with flanged-on drive units or motors can be used. A main gear can also be used that has a drive alignment that is at right angles, or standing, relative to the direction of travel. A main gear with lengthwise flanged-on or vertically flanged-on motor(s) or drive units, in other words motor and brake plus coupling, can also be used.

Furthermore, the space requirement is substantially less, since the endless arrangements are arranged very close to each other, and form a compact construction unit. Moreover, no building space is wasted, and an optimal utilization of space and electric power is attained. The level of performance of the conveyance device(s) is increased, and the performance curve and/or transportation capacity rises. Improved utilization of the equipment and materials that are used, and the energy and/or driving force that are supplied, are attained.

Moreover, the regulations are fulfilled that prescribe a maximum distance (typically maximum 110 cm) between the side balustrades.

I claim:

1. A conveyance device with a first and second parallel endless arrangements of tread steps drivable by driving means in a direction of transportation for the purpose of transporting persons, and a balustrade construction comprising a first outer balustrade with a handrail drivable in the direction of transportation located at an outer long side of the first arrangement, a second outer balustrade drivable in the direction of transportation located at an outer long side of the second parallel arrangement, and a single, common balustrade for the first and second arrangements located between the first and second arrangements located and adapted to be usable simultaneously by persons on both arrangements and having a second handrail drivable in the direction of transportation the driving means simultaneously driving the first and second arrangements in the direction of transportation.

2. A conveyance device according to claim 1, further having a third handrail driven simultaneously with, and in the same direction as, the second handrail.

3. A conveyance device according to claim 2, wherein the single common balustrade has a first partial balustrade with a first handrail element bordering on the first endless arrangement and a second partial balustrade with a second handrail element bordering on the second endless arrangement.

4. A conveyance device according to claim 3, wherein the first endless arrangement, the first handrail, and the first handrail element are driven at a first speed, the second endless arrangement, the third handrail and the second handrail element being driven at a second speed.

5. A conveyance device according to claim 2, wherein the two endless arrangements and the three handrails are adapted to be driven synchronously.

6. A conveyance device according to claim 2 wherein the two endless arrangements have a common truss.

7. A conveyance device according to claim 6, wherein the truss has a common double truss frame.

8. The conveyance device of claim 1 wherein the single, common balustrade has only a single handrail, adapted for simultaneous use by persons on the first and second endless arrangements.

9. A conveyance device with a first endless arrangement of tread steps for transporting persons driveable by driving means, wherein present adjacent to a first long side of the first endless arrangement of tread-steps is a first side balustrade with a first handrail which is drivable in the direction of transportation and on the second long side of the first endless arrangement is a second side balustrade with a second handrail which is driveable in the direction of transportation, characterized in that the conveyance device contains a second endless arrangement with tread steps arranged parallel and adjacent to the first endless arrangement and which, simultaneous with the first endless arrangement, is driveable by the driving means in the direction of transportation, the second side balustrade being embodied as a sole middle balustrade and arranged on a first long side of the second endless arrangement for use by persons on both the first and second endless arrangement, a third side balustrade with a third handrail being located on a second long side of the second endless arrangement which, simultaneous with the second handrail, is driveable in the direction of transportation.

10. The conveyance device of claim 9, wherein the sole middle balustrade has only a single handrail for use by persons on both the first and second endless arrangements.

* * * * *